US008075416B2

(12) United States Patent
Stites et al.

(10) Patent No.: US 8,075,416 B2
(45) **Date of Patent: *Dec. 13, 2011**

(54) ADJUSTABLE PUTTER ALIGNMENT AIDE

(75) Inventors: John T. Stites, Weatherford, TX (US); David N. Franklin, Granbury, TX (US)

(73) Assignee: Nike, Inc., Beaverton, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/862,047

(22) Filed: Aug. 24, 2010

(65) Prior Publication Data

US 2010/0317451 A1 Dec. 16, 2010

Related U.S. Application Data

(63) Continuation of application No. 12/464,657, filed on May 12, 2009.

(51) Int. Cl.
*A63B 69/36* (2006.01)

(52) U.S. Cl. ..... 473/238; 473/244; 473/251

(58) Field of Classification Search ..... 473/219–256, 473/131, 324, 340, 341; D21/736–746, 759
See application file for complete search history.

(56) References Cited

U.S. PATENT DOCUMENTS

| | | | |
|---|---|---|---|
| 1,039,491 | A | 9/1912 | Collins |
| 1,173,384 | A | 2/1916 | Rees |
| 1,897,264 | A | 2/1933 | Lamb |
| 3,033,574 | A | 5/1962 | Partridge |
| 3,199,873 | A | 8/1965 | Surratt |
| 3,292,928 | A | 12/1966 | Valentine |
| 3,753,564 | A | 8/1973 | Brandell |
| 3,829,102 | A | 8/1974 | Harrison |
| 3,979,125 | A | 9/1976 | Lancellotti |
| 4,291,883 | A | 9/1981 | Smart |
| 5,160,142 | A | 11/1992 | Marshall |
| 6,386,987 | B1 | 5/2002 | Lejeune, Jr. |
| 6,558,268 | B2 | 5/2003 | Tindale |
| 7,077,757 | B1 | 7/2006 | Payne et al. |
| 7,335,112 | B1 | 2/2008 | Bitondo |
| 7,371,184 | B2 | 5/2008 | Tao |
| 2003/0054900 | A1 | 3/2003 | Tindale |
| 2004/0229707 | A1 | 11/2004 | Lin |
| 2009/0118035 | A1 | 5/2009 | Roenick |

FOREIGN PATENT DOCUMENTS

| | | |
|---|---|---|
| WO | 2004071594 | 8/2004 |
| WO | 2008154684 | 12/2008 |

OTHER PUBLICATIONS

Partial International Search Report for PCT/US2010/033997, mailed Aug. 30, 2010.

*Primary Examiner* — Sebastiano Passaniti
(74) *Attorney, Agent, or Firm* — Banner & Witcoff, Ltd.

(57) ABSTRACT

A golf club head with a body and a pivotable alignment aide non-removably housed on a top surface of the body is provided. The pivotable alignment aide is pivotable relative to the top surface and about an axis of rotation transverse to the top surface. The pivotable alignment aide may be coupled to the remainder of the golf club head through a resistive connection and may be shifted to assist a golfer in squaring the face of the golf club face to a perceived eye line and resulting in the golfer being able to better square the golf club head with the eye line at a point of contact. The golf club head may be a golf club head for a putter.

17 Claims, 12 Drawing Sheets

ADJUSTABLE PUTTER ALIGNMENT AIDE

RELATED APPLICATION DATA

This application is a continuation of prior application Ser. No. 12/464,657 filed on May 12, 2009 entitled "Adjustable Putter Alignment Aide" and naming John T. Stites and David N. Franklin as the inventors. This application is incorporated herein by reference in its entirety.

FIELD OF THE INVENTION

The present invention relates to a golf club, more particularly, to a golf club head for a putter having an adjustable alignment aide.

BACKGROUND

Putting is an aspect of golf in which a golfer attempts to hit or "putt" the ball into the hole from the ball's position on a green or a like surface. Preferably, the golfer can putt the ball into the hole in as few attempts as possible. To do so, a golfer may align, either by sight or other perceptive techniques, the golf ball so as to hit the ball with a velocity and direction that will cause the ball to terminate its travel path in the hole or as close to the hole as possible if not in the hole. As such, a golfer can achieve a lower score which is preferred and the objective according to golf rules. Various techniques may be utilized by golfers in order to putt the golf ball in a preferred manner such that the golf ball travels into or near the hole more frequently. Among the techniques a golfer may use is to determine a desired path and velocity for the ball to travel. The golfer may attempt to putt the golf ball on this desired path and accordingly may attempt to align himself in a manner to facilitate putting the ball along the desired path with a desired velocity to go into or near the hole.

SUMMARY

A golf club head with a pivotable alignment aide non-removably housed on a top surface of the body and pivotable relative to the top surface and about an axis of rotation transverse to the top surface is provided. The pivotable alignment aide includes a pivot and a rotating end opposite the pivot. The golf club head may further include an alignment aide pivot guidance mechanism. The pivot guidance mechanism may be of a number of configurations including a track and complimentary follower member mechanism. The pivotable alignment aide may be pivoted in opposing directions relative to a start position in which the front side of the pivotable alignment aide is parallel (or square) with a hitting surface of the golf club head. The pivotable alignment aide may be coupled to the golf club head with by a resistive connection and one or more user engagement structures may be housed on the pivotable alignment aide to facilitate user manipulation.

In another aspect a golf club head has a body configured for putting and a triangularly shaped pivotable alignment aide housed on a top surface of the body. An alignment aide axis of rotation is transverse to the top surface. The triangularly shaped pivotable alignment aide is rotationally secured to the top surface at a pivot located at the intersection of the alignment aide and an axis of rotation. Also, a first and second side of the triangular shaped pivotable alignment aide are equivalent in length, and the triangular shaped pivotable alignment aide is configured to be symmetrical across a line perpendicular to a third side of the triangular shaped pivotable alignment aide. The pivotable alignment aide may be configured such that it is visually distinct relative to the top surface of the body of the golf club head.

DESCRIPTION OF THE DRAWINGS

The foregoing Summary of the Invention, as well as the following Detailed

Description of the Invention, will be better understood when read in conjunction with the accompanying drawings.

DETAILED DESCRIPTION

Figure 1A:
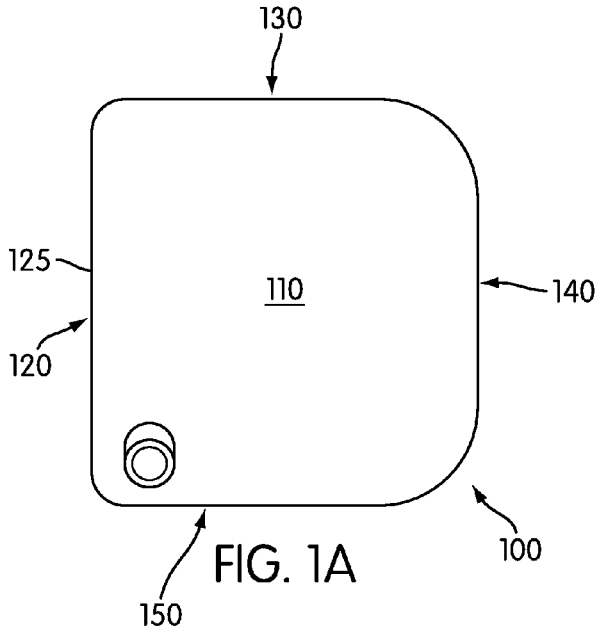
FIGS. 1A-1D are top, toe end, heel end and front views respectively of an illustrative golf club head.
Figure 1B:
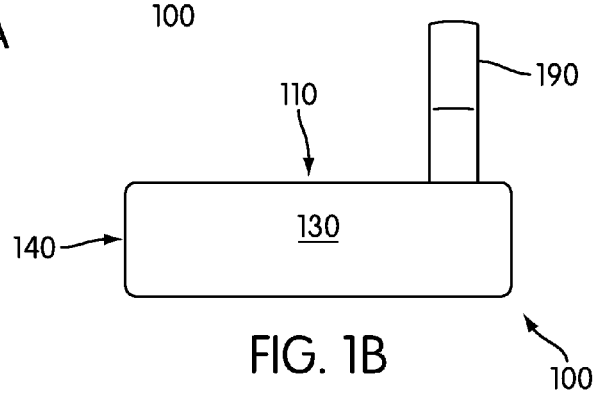
Figure 1C:
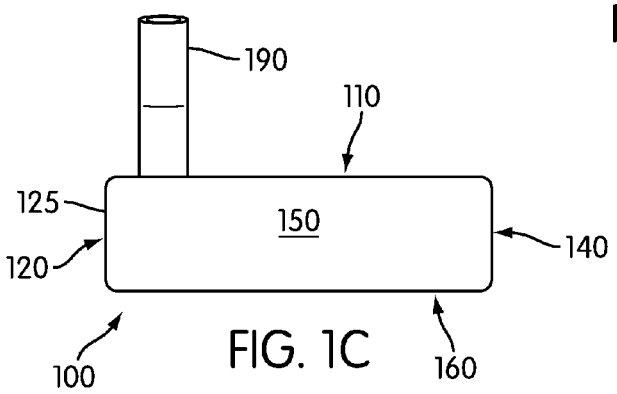
Figure 1D:
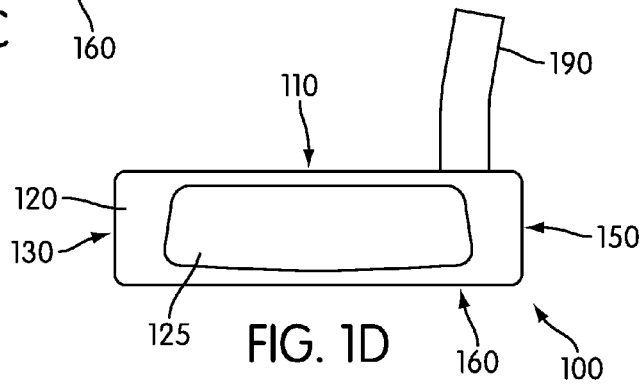

In the following description of the various embodiments, reference is made to the accompanying drawings that depict illustrative arrangements in which the invention may be practiced. It is understood that other embodiments may be utilized and modifications may be made without departing from the scope of the present invention.

FIGS. 1A-1D are schematic top, toe end, a heel end and front views, respectively, of an illustrative golf club head 100 for a putter. As apparent from the figures, a golf club head 100 may illustratively be considered to include a top 110, a front 120, a toe end 130, a rear 140, a heel end 150 and a bottom (or sole) 160. Further, a golf club head 100 typically includes a hosel 180 formed to, among other things, facilitate connection of the golf club head 100 to the shaft 190. Hosel(s) 180 and shaft(s) 190 are well known in the art. Hosels 180 are commonly formed with the remainder of the golf club head for a putter 100 as a single body member.

Front surface 120 typically includes a hitting surface 125 configured for striking a golf ball. Hitting surface 125 may include any of a variety of features, configurations, shapes, surfaces and details. For example, hitting surface 125 may include a series of grooves or other textures that facilitates travel of the golf ball when the hitting surface 125 impacts a golf ball. Spacing, size, depth, shape, contour and orientation of these grooves may be varied to provide varied characteristics. Also, hitting surface 125 may be formed of a softer or harder material or may be treated to strengthen or soften the material in anticipation of the hitting surface repeatedly being used to impact the golf ball. By varying the hardness of some of the material the feel of the golf club head may be varied. For example, it may be desirable to have a softer hitting surface 125 compared to the other surfaces of the golf club head. In contrast, it may be desirable for a hitting surface of a driver or iron-type club to have a hardened hitting surface 125. Many other forms of surface treatments and ornamentation may be incorporated into the hitting surface 125, from hardened materials to holes, grooves, and corrugation and various other hitting surface materials, structures and configurations that are well known.

The illustrative golf club head 100 illustratively shown in FIGS. 1A-1D may be commonly referred to as a golf club head for a putter 100. Putters are golf clubs often formed with a grip 195, a shaft 190, and golf club head 100 that is formed and configured for hitting or putting a golf ball on a "green" or other like surfaces upon which a golfer may putt a golf ball. Generally, a putter 199 has a head 100 formed and shaped to cause a ball to be rolled along a flat surface when the ball 201 is properly struck by the club 199. The golf club head 100 can be weighted. Putters vary greatly in their shape, size and appearance. A putter is generally swung slower and with a much shorter swing than other types of golf clubs such as wood-type or iron-type golf clubs since putters are generally used to hit golf balls shorter distances with more precision. As such, putters may be formed to facilitate hitting the golf ball in a precise direction and with a precise speed to assist the golfer in hitting the golf ball into or near to the hole 299.

Accordingly, the golf club head for a putter 100 may be formed with less focus on aerodynamic principles as well as with less focus on the feel of the club in a full backswing and downswing as performed with other types of golf clubs as known in the art. This is possible since a putter is typically only moved through a partial backswing and a partial downswing. The golf club head 100 may be weighted throughout to provide more feel to the golfer in such a swing. The weighting may be accomplished by having material dispersed throughout the golf club head 100 or it may be accomplished utilizing one or more regions of material placed or inserted in specific locations. The weighting of the golf club will help facilitate the stroke of the putter 199 and will allow a smoother and more accurate putt. Therefore, the weighting of the golf club can be balanced in manners to place the center of mass at certain locations to provide a preferred stroke and contact with the golf ball. Additionally, the golf club head 100 may have a certain desired overall weight such that the momentum of the putter will be less affected when the golf club head 100 contacts the stationary ball as certain momentum and force is needed to start the ball rolling to overcome the inertia of the stationary golf ball while still holding the swing and club in a controlled path.

Other characteristics of the golf club head for a putter 100 may be formed to facilitate a preferred putting stroke. For example, a bottom surface 160 (or portions of the bottom surface 160) of the golf club head 100 has a flat profile complimentary to a flat surface of a putting green. The bottom surface 160 may be a continuous solid profile or in many cases the bottom surface 160 may include cavities, recesses, holes and other variations in the topography of the bottom surface 160. Additionally, the golf club head for a putter 100 may have a hitting surface 125 formed of a distinct material, surface coating, or finish compared to the rest of the front surface 120. In one configuration, a hitting surface 125 may be formed as an insert on the front surface 120 of the golf club head for a putter 100. The insert 125 may be formed of a softer material or a have a softer coating than the remainder of the front surface 125 so that weighting properties may be optimized while still providing a softer (and/or more absorbent) hitting surface 125 to provide enhanced control for the golfer when putting. Additionally, the shape of the golf club head for a putter 100 may be formed to provide alignment properties resulting in a preferred putting stroke. The golf club head for a putter 100 may be an elongated structure in one configuration. Also, the golf head for a putter 100 can include cut-outs, bulges, spherical structures, channels and various other configurations that facilitate alignment and/or weighting of the club. In particular, causing a center of mass of the putter head to be aligned with a "sweet spot" on the hitting surface 125 is desirable in many instances.

Figure 2:
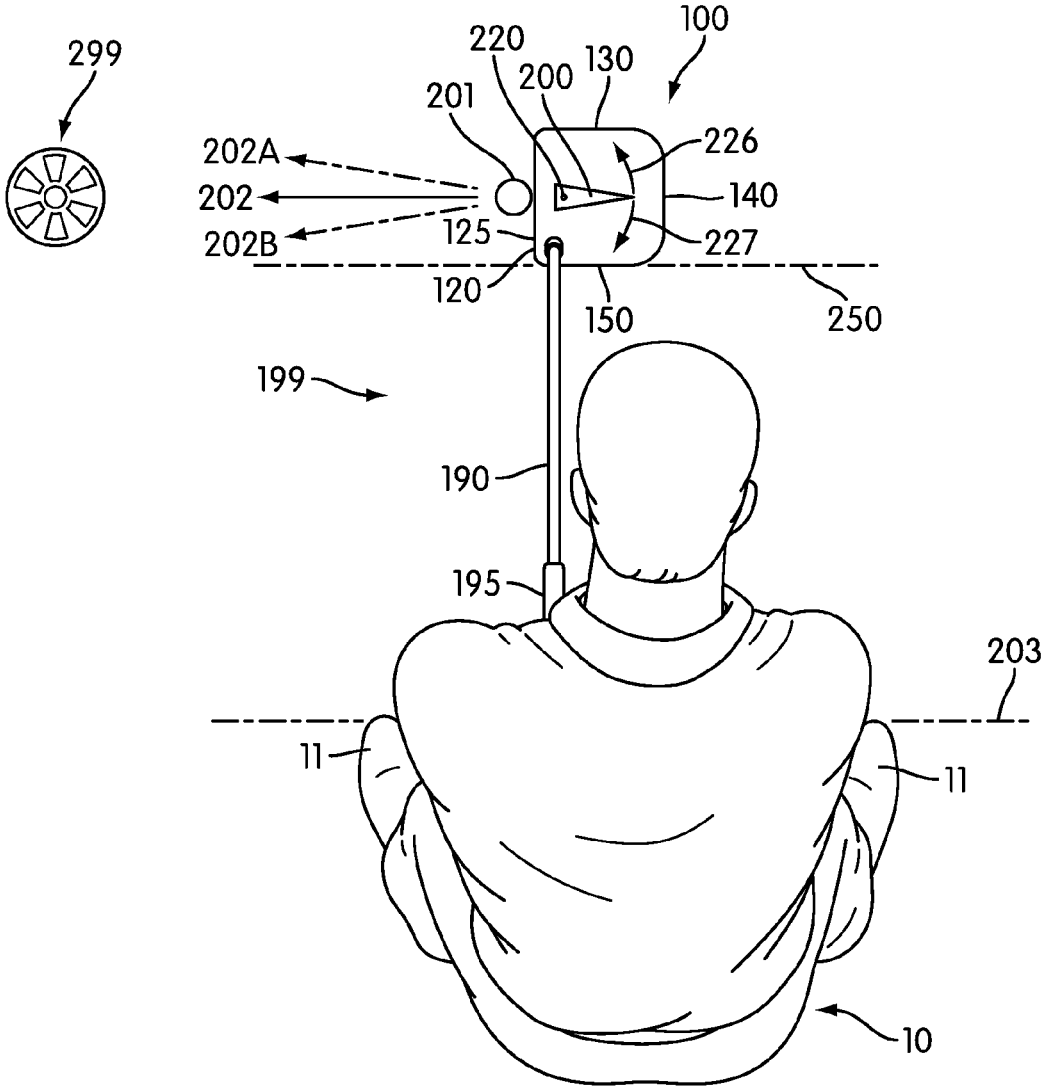
FIG. 2 is an illustrative top plan view of a golfer addressing a golf ball with a putter.

FIG. 2 is an illustrative top plan view of a golfer 10 addressing a golf ball 201 with a golf club head 100. The addressing state shown in FIG. 2 is generally considered an illustrative start position for a golfer putting a golf ball 201. The golf club 199 (here a putter) typically includes a shaft 190 coupled to the head 100. The shaft 190 may be attached at a recess or hole in the top surface 110 of the golf club head for a putter 100. The shaft could also be fused or otherwise structurally attached to the top surface 110 of the golf club head for a putter 100 directly. In other configurations, the shaft may be coupled to the golf club head for a putter 100 via the hosel as is known. A grip 195, by which a golfer 10 holds or grips the golf club, is attached to the shaft 190 at the end opposite the head 100. Grips 195 are known and may vary significantly depending on preferences, ergonomic characteristics, and tendencies of the golfer. For example, grips vary in "grip size" and in circumference. They also vary in particular texture and grip pattern on the outer surface of the grip. Grips can be round or may have a line or rib on the underside to assist the golfer in placement of his hands. Other shapes are also contemplated. Grips may be composed of a number of materials including rubbers, polymers, and leather, to name a few. The grip traits may be varied by, for example, by making the grip corded or selecting any of various materials based upon the frictional properties of that material.

Shaft 190, as is also known in the art, may be varied in length, material composition, stiffness, flex and other traits and features. For example, golfers may select shafts 190 formed of a variety of materials in light of characteristics of those materials. Shafts 190 may be chosen for putters based upon a preferred length. Depending on the preferred stance of a golfer during putting, shafts of varied lengths may be utilized in conjunction with the golf club head for a putter 100. In one configuration, an extremely elongated shafted with an elongated grip may be chosen if the golfer prefers to be putt in an almost standing or erect stance as a few unique golfers have utilized to notoriety. In another configuration, the golfer may have a somewhat bent over posture consistent with a traditional golf putting posture. In such a configuration, a shorter shaft 190 may be utilized. Like other golf club features, the shaft 190 and grip 195 will often be selected based upon golfer "feel" as well as traits relating to the golfers physical make-up and putting or swing characteristics and tendencies.

As apparent in FIG. 2, golfers generally position their feet 201 in an orientation generally aligned in the direction in which the golfer desires or is aiming to putt the golf ball 201. The golfer's position in FIG. 2 may be referred to as an addressing state or a starting state. For reference purposes, broken line 250 illustrates a heel end plane running along the heel end 150 of the golf club head and perpendicular to the ground (assuming the ground is flat). As apparent, the heel end plane 250, when the golfer 10 is in a typical addressing state as shown in FIG. 2, is parallel to the general desired travel path 202 and the golfer's feet alignment 203. Foot positioning may be varied from this illustrative positioning as is known in the art so as to be askew by a certain rotation from the general desired travel path. For illustrative purposes in FIG. 2, arrow 202 demonstrates one "general" desired path of travel of the ball 201 after the golfer 10 strikes the golf ball 201 with the front 120 (the face) of the golf club 199. As will be explained in more detail later with regard to FIG. 4, a golfer's general desired travel path after contacting the ball 201 may align with a golfer's perceived eye line 202. In the configuration of FIG. 2, the golfer's feet, as demonstrated by the arrow 203, illustratively depicts the alignment of the golfer's feet or stance as being generally parallel with the general desired travel path of the ball 202. As known, an actual travel path of the ball 201 may vary from the general desired travel path as the front surface 120 including the hitting surface 125 of a golf club head of a putter 100 may not be square or aligned with the golfer's perceived eye lines 202 or the general desired path of travel of the golf ball 202 after the golfer has made contact.

As generally shown and described in more detail later, putting greens and like surfaces (including fairways near a putting green) are typically not completely flat and have what is commonly referred to and known in the art at as "breaks." For example, a putting green may have a number of slopes, hills, and other varied topography such that a golfer must aim or align a putt or other shot, taking into account "the break" that will cause the path of actual travel of the ball to be curved and varied. Since the ball typically rolls across the grass of the green (or like surface) as is it travels, the ball's travel path will be affected by the surface of the green including variations in the topography. For example, if a golf ball 201 is resting on one side of a green and the hole is on the other side of a green and between the hole and the ball is a hill that slopes downward from right to left, a golfer must hit the ball with an initial direction that is a certain distance or angle rightward of the hole because the hill sloping downward from right to left (as a result of gravity) will force the ball's path of travel to curve leftward during travel in varying extent depending on the specifics relating to the moving or rolling golf ball and its path of travel including particular size gradients of the right to left slope, velocity, direction, friction between rolling golf ball and the surface of the green, wind, and various other factors as are known.

A golfer may view the position of a golf ball 201 relative to a hole 299 from a number of positions to judge the breaks, slopes, distance and other golf course and environmental features to be able to formulate a desired travel path for the ball as well as a desired initial velocity of the golf ball when he putts the golf ball such that the ball 201 will go in the hole or come to rest as close to the hole as possible consistent with the objectives of the sport of golf as known in the art. The golfer may use a perceived eye line 202, 202A, 202B to formulate the path in which the golfer wishes to hit or putt the golf ball. Since the golfer will often be viewing and formulating a perceived eye line 202, 202A, 202B from above and or behind the ball, the golf club head for a putter 100 with a pivotable alignment aide 200 facilitates the golfer's ability to determine the perceived eye line 202, 202A, 202B and then to hit or putt the golf ball such that the hitting surface 125 contacts the ball in an orientation square with the perceived eye line 202, 202A, 202B (or others not shown) causing the golf ball to initially travel along the perceived eye line 202, 202A, 202B (or others not shown).

Figure 3A:
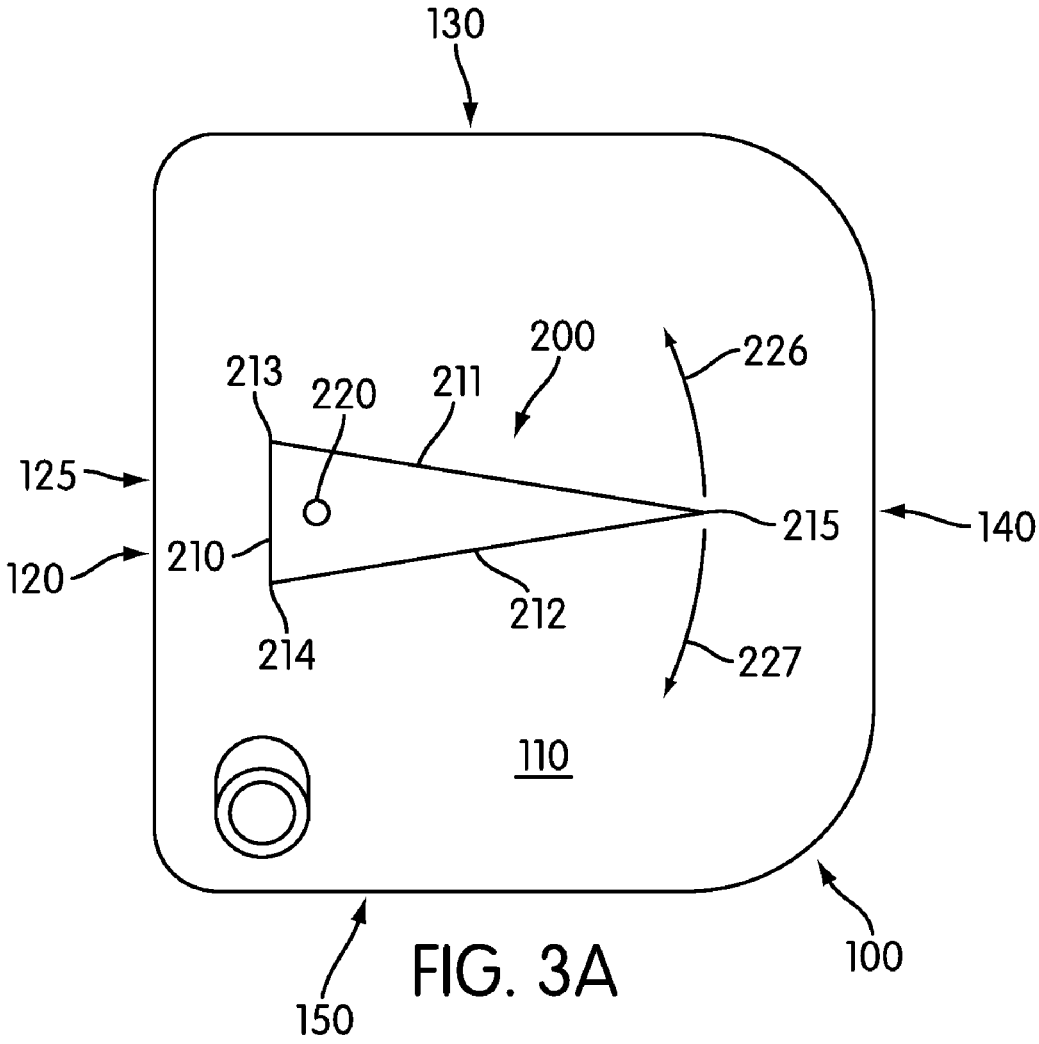
FIGS. 3A-3C are illustrative schematic top, front perspective and rear perspective views of a golf club head for a putter including a pivotable alignment aide.
Figure 3B:
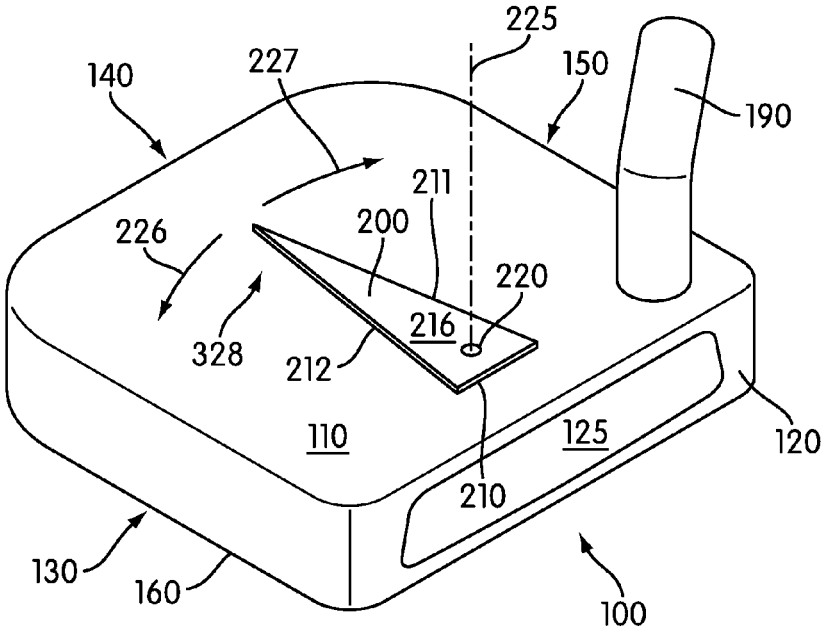
Figure 3C:
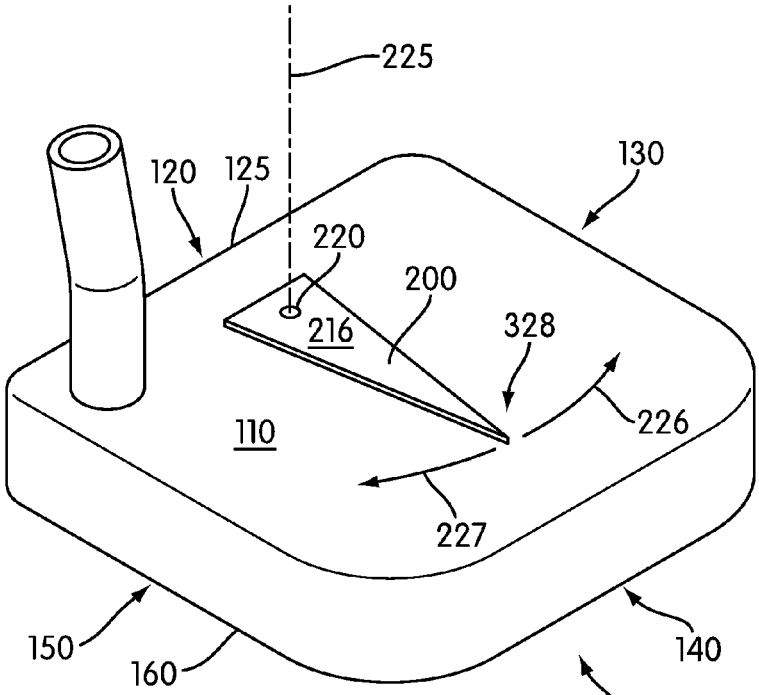

FIGS. 3A-3C are top, front perspective and rear perspective views of a golf club head for a putter 100 that includes a pivotable alignment aide 200 housed on a top surface 110 of the golf club head 100. In this configuration, the pivotable alignment aide 200 may be described as being triangularly shape and having three sides 210, 211, 212 forming three corners 213, 214, 215. Further, in this particular configuration the pivotable alignment aide 200 is formed as an isosceles triangle with two sides 211, 212 being equivalent in length. The pivotable alignment aide 200 is rotationally coupled to the golf club head for a putter 100 by pivot 220 on the top surface. Pivot 220 is housed within the perimeter of pivotable alignment aide 200. Pivot 220 is configured to form an axis of rotation 225 transverse to the top surface 110 about which the pivotable alignment aide may be rotated. As apparent, the pivot 220 in the configuration is positioned closer to the front surface 120 of the golf club head than the rear end 140 of the golf club head 100. In such a configuration, corner 215 will move a greater distance than the corners 213 or 214, as corner 215 is positioned further from the pivot 220 than corners 213, 214. In this configuration pivotable alignment aide 200 is a raised structure as the top surface 216 of the pivotable alignment aide 200 sits above the top surface 110 of the remainder of the golf club head for a putter 100. In being a pivotable alignment aide 200 sitting or raised above the top surface 110 of the golf club head for a putter 100, the thickness of the pivotable alignment aide 200 itself acts as a user engagement structure 328 protruding from a top surface 110. However, as described further below, other configurations of user engagement structures 328 may be housed on the pivotable alignment aide 200 to facilitate rotation, adjustment, movement, and any other manipulation of the pivotable alignment aide 200. For example, a user may apply a force with his or her hand on the corner 215 to adjust the orientation of the pivotable alignment aide 200.

Figure 4:
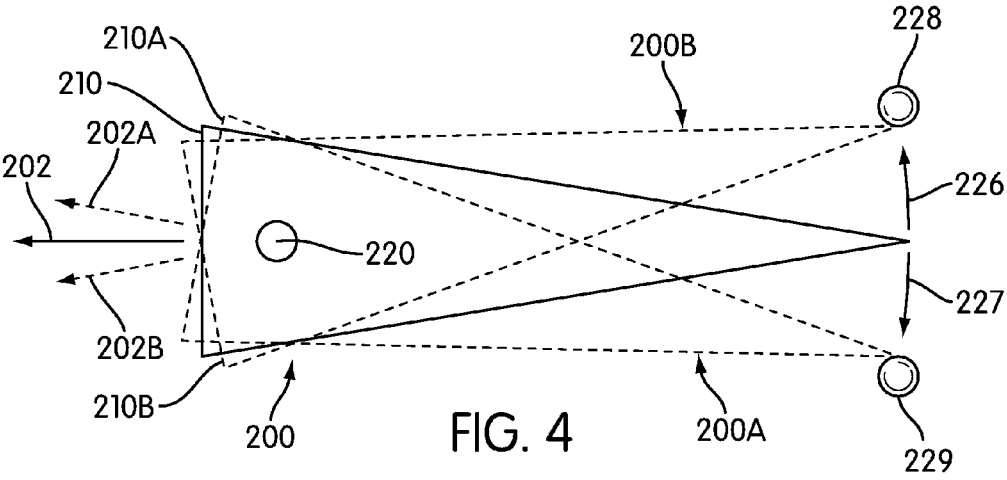
FIG. 4 is an enlarged illustrative schematic top view of a pivotable alignment aide for a golf club head.

The pivotable alignment aide 200 in the configuration depicted in FIGS. 3A-3C illustrates a pivotable alignment aide 200 in a start position. In a start position the first or front side 210 is shown as being parallel to the front surface 120 and hitting surface 125 of the golf club head for a putter 100. The orientation of the pivotable alignment aide when in the start position or addressing state may be commonly referred to as being "square" with the club face. From this start position or addressing state, the pivotable alignment may be rotated in either of two opposing directions 226, 227. Rotational directional arrows 226, 227 illustrative depict the two opposing direction of rotation that corner 215 may be rotated about pivot 220 as well as a range of rotation that the corner 215 of the pivotable alignment aide can be rotated FIG. 4 is an enlarged illustrative schematic top view of a pivotable alignment aide 200 for a golf club head further demonstrating the movement and/or rotational characteristics of one configuration of pivotable alignment aide. The broken line showing the pivotable alignment 200A illustratively depicts and example orientation of the pivotable alignment aide 200 after being rotated a range of rotation/direction 227. In the orientation of 200A, the front side 210 is also rotated to an orientation shown by broken lines as front surface 210A. In this position, a desired travel path 202A of the golf ball 201 may be visually indicated using the pivotable alignment aide 200. Accordingly, the golfer 10 will have rotated the pivotable alignment aide 200 into an orientation or position in his eye line with the rotated pivotable alignment aide 200A and thereby aligning the desired travel path 202A with the square front surface 210A. In similar fashion, a golfer can align the pivotable alignment aide 200 in an orientation for hitting the golf ball in a desired travel path of 202B by rotating the pivotable alignment aide 200 in a range and direction of rotation 226. In particular, corner 215 can be rotated through the range of rotation 226. As such, front surface 210B is perpendicular or square to the desired travel path 202B of the golf ball 201 and the golfer 10 has positioned the pivotable alignment aide 200B in the golfer's eye line to facilitate hitting a putt in the desired direction.

While FIG. 4 demonstrates the position and orientation of the pivotable alignment aide 200 in a position 200A and 200B, it should be understood and evident that numerous positions and orientations along various ranges of pivots may be utilized and are consistent with the principles described herein. For each of a number of golf shots, and putts in particular, a golfer may rotate the pivotable alignment aide a certain distance and direction as desired in light of the specific characteristics of the shot or putt. In certain configurations, the ranges of motion from the start or square position may be equivalent in opposing directions. However, the ranges of motions may also be formed to be different in the opposing directions 226, 227 or the pivotable alignment aide 200 in certain configurations may be formed to only be able to rotate in one direction from the start position or addressing state. On any given putt the golfer may move the pivotable alignment aide 200 a small amount in one direction, a large amount in the other opposing direction and practically any other combination of rotation distances, and directions, as shown in FIG. 4. Corner 215, in being situated on an opposing end from the pivot moves through the largest range and distance of rotation. Here, corner 215 may be referred to as a rotating end of the pivotable alignment aide 200. In certain configurations as is further described below, the pivot 220 may be more centrally located within the pivotable alignment aide 200 and in these configurations the pivotable alignment aide 200 may have two opposing rotating ends. However, when the pivot 220 is positioned to be near one side or end of the pivotable alignment aide 200, the opposing side may be referred to as the rotating end 215 since that particular end tends to be the end that is rotated about the pivot while the end comparatively close to the pivot may merely swivel and not rotate to the extent of the opposing end.

Also, it may be noted that FIG. 4 illustratively demonstrates utilization of what may be referred rotation stops 228, 229 along with pivotable alignment aide 200. In FIG. 4, a pair of opposing rotation stops 228, 229 are placed and act to define a boundary of range of rotation 226, 227 in each of the opposing directions. In FIG. 4 the rotation stops 228, 229 are depicted as solid circular or hemispherical members housed in the top surface of the golf club head, but many other configurations are contemplated. In certain configurations, a rotation stop may be in the form of the physical structure of the top surface 110 such as when a groove and follower are utilized in conjunction with the pivotable alignment aide 200. The two opposing ends of the groove may act as rotation stops since the pivotable alignment aide cannot be rotated further due to the resistance/integrity of the top surface 110 of the golf club head for a putter 100. Other configurations of rotation stops may include a catch mechanism, further natural ends to the rotational range such as a last notch in a ratchet mechanism, other various shaped physical obstructions (e.g., cylindrical members, pegs, blocks, etc.) that prevent further rotation of the pivotable alignment aide 200 and various other structures as are known in the art.

In various configurations the range of pivot or rotation that the pivotable alignment aide 200 is configured to travel may be varied. The pivotable alignment aide 200 may be configured such that the ranges of rotation of pivot 226, 227, or the maximum distance the pivotable alignment aide 200 may rotate, is a certain number of degrees in one or both direction. For example, in one configuration the range of rotation or pivot 226 and the range of rotation or pivot 227 may both be the same, and in particular, may both be ten degrees relative to the start position. In such an arrangement, the pivotable alignment aide 200 is accordingly configured to be able to pivot twenty degrees total (ten degrees in each of the opposing directions as demonstrated by the ranges of rotation or pivot 226, 227). While an arrangement in which the pivotable alignment aide 200 may pivot ten degrees in each of the opposing directions may be desirable in certain configurations as typical putting alignments with the golf ball may often be within that range of motion 226, 227, various other arrangements may include various ranges of motion smaller than that described as well as ranges of motion larger than that in various configurations. Also the ranges of motion may be varied such that the ranges of rotation or pivot 226. 227 might be different. For example, the range of pivot 226 might be thirteen degrees while the range of pivot 227 might be nine degrees. Numerous other arrangements with various ranges of motions are contemplated and may be utilized.

Figure 5A:
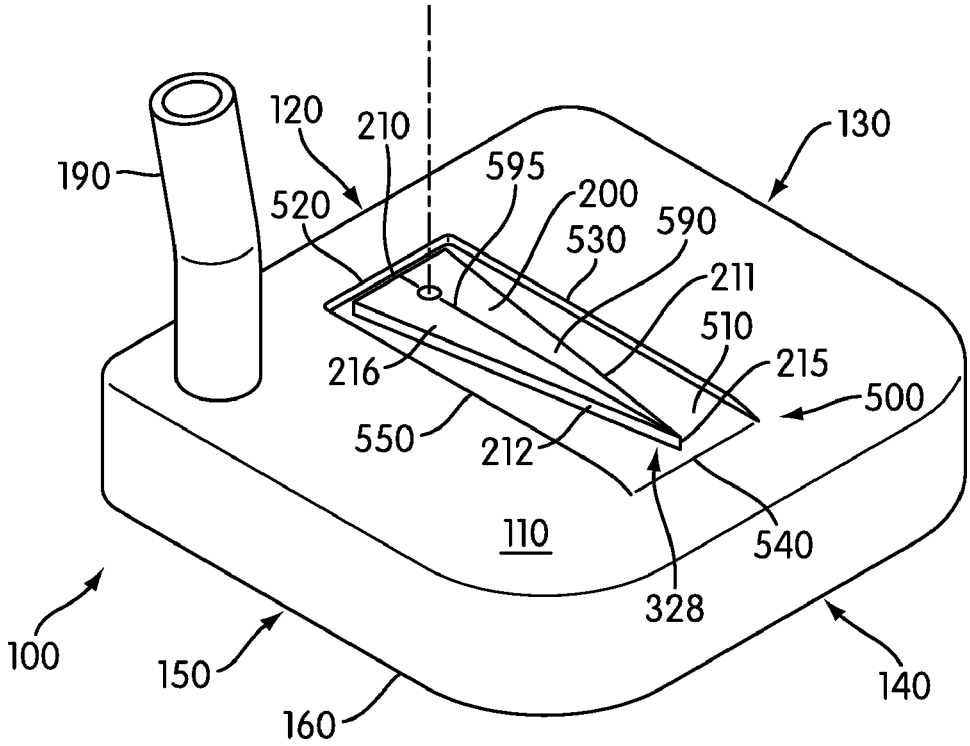
FIGS. 5A-5B are illustrative schematic rear perspective and rear views of another arrangement of a golf club head for a putter including a pivotable alignment aide.
Figure 5B:
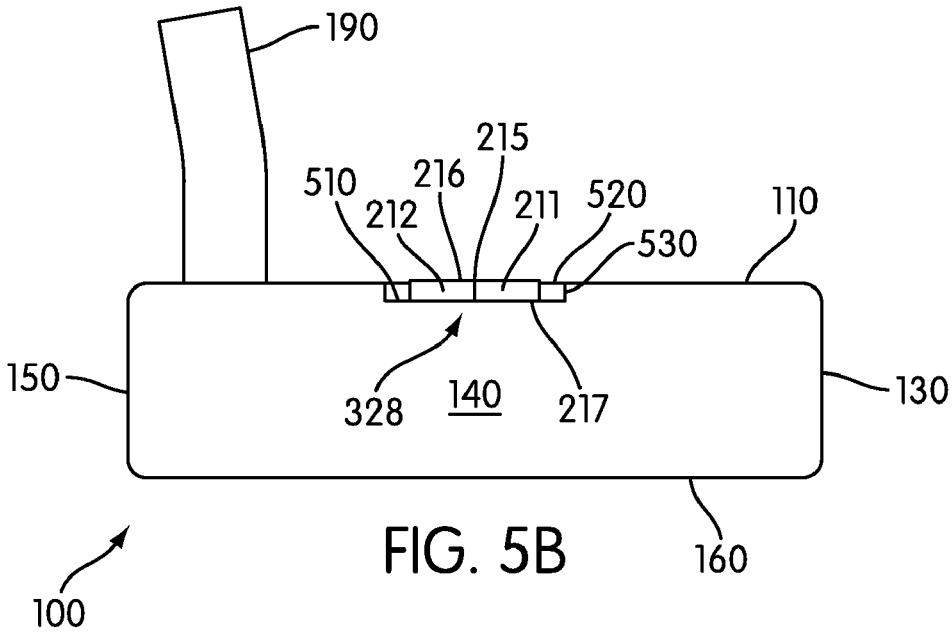

FIGS. 5A-5B illustrate further schematic rear perspective and heel end views of another arrangement of a golf club head for a putter 100 including a pivotable alignment aide 200. Here, a rectangular recess 500 is formed in the top surface 110 of the golf club head for a putter 100. The recess in this configuration has four sides 520, 530, 540, 550. Also, bottom 510 is a bottom or floor surface of the recess 500. In this configuration, the pivotable alignment aide 200 is housed in the recess 500. The pivotable alignment aide 200 has a bottom surface 217 that may skim over the bottom surface 510 of the recess 500 as the pivotable alignment aide 200 is rotated from the start position or addressing state into an alignment position in either of the opposing directions of rotation 226, 227. Also, sides 530 and 550 of the recess are configured to act as rotation stops 530, 550 defining an outer boundary of the range of rotation in each of the opposing rotation directions. Rotating end/corner 215 and/or one of the sides 211, 212 will physically engage sides 530 or 550 thereby stopping the rotation of the pivotable alignment aide 200 and serving as an outer boundary of rotation.

As shown, the pivotable alignment aide 200 in FIGS. 5A-5B is housed in the recess 500 and sits such that the top surface 216 of the pivotable alignment aide is "flush" with the top surface 110 of the golf club head for a putter 100. When the pivotable alignment aide 200 is housed in the recess 500 as shown, the golf club head for a putter 100 possesses a sleek profile in that the inclusion of a pivotable alignment aide 200 does not cause the golf club head for a putter 100 to have a protrusion extending upward beyond the general top surface profile of the putter. Putting, like most shots in golf, rely on a golfer's touch and feel. A sleek putter profile provides a desired feel for certain putters. Further, housing pivotable alignment aide in the recess 500 permits use of the many benefits of a pivotable alignment aide 200 when the golf club head for a putter 100 is viewed from the top or related overhead views as shown in FIG. 5A in combination with a sleek understated profile from a front or rear view, such as FIG. 5B, in which the pivotable alignment aide 200 occupies a minimal or negligible portion of visible portion of the golf club head 100. For example, in certain front views of the golf club head for a putter 100 of FIGS. 5A-5B, the pivotable alignment aide may not be visibly apparent whatsoever. Accordingly, the feel of a smooth outer surfaced golf club head for a putter 100 may be accomplished while simultaneously providing the golfer a golf club head for a putter 100 with a pivotable alignment aide 200 for facilitating alignment of golf shots. Additionally, some aerodynamic advantages may be gained by housing the pivotable alignment aide 200 in a recess 500 rather than in a configuration protruding above a top surface 110, but these aerodynamic gains may not be extensive as a typical putting swing may be significantly slower and shorter than other types of golf swings or strokes such that aerodynamic traits such as drag may be negligible. However, these same characteristics may be important in the swing of an iron-type or wood-type golf club head. As such, in configurations in which a pivotable alignment aide is utilized on an iron-type or wood-type golf club head as is contemplated (but not shown here), aerodynamic traits and advantages may be more extensive.

FIGS. 6A-B, 7A-B, and 8A-D illustratively depict further configurations of a golf club head for a putter 100 including a pivotable alignment aide 200. Each configuration demonstrates varied features, aspects and particulars regarding the golf club head for a putter 100 and its associated pivotable alignment aide 200. While each of these golf club heads for a putter 100 may be shaped and shown to have a certain shape and size, it is known that golf club heads for a putter may have many varied shapes, sizes and geometries. It is known that golf club heads for putters may be circular, square, elongated, intricate geometric shapes and an extremely large number of shapes and geometries. For example, Nike® makes numerous configurations of putters having a variety of golf club head shapes, sizes and characteristics including Nike IC Series Putters, Nike Unitized Putters, Nike OZ Putters, Nike Ignite Putters and numerous other types and series of putters. These putters are merely illustrative of some of the shapes, size and configurations of putters and golf club heads for putters as various other golf club heads for a putter and putters are available from various golf equipment makers and manufacturers. As such, the described golf club heads 100 including golf club heads for a putter shown and described herein are illustrative as various other particular shape, sizes and other characteristics etc., are specifically contemplated consistent with that described herein.

Figure 6A:
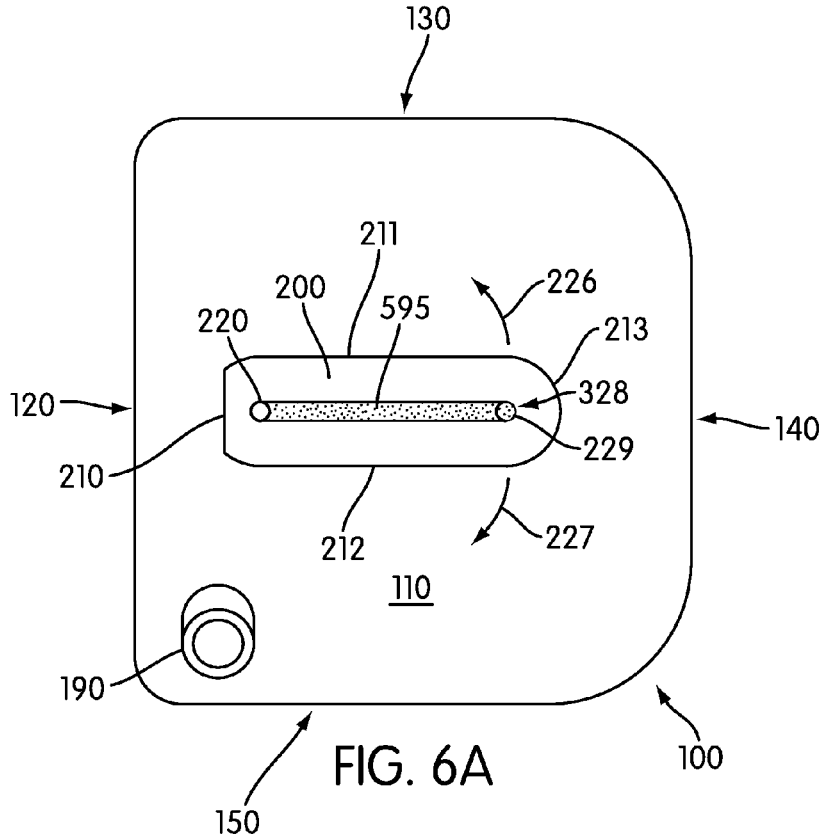
FIGS. 6A-6B are illustrative schematic top and rear perspective views of another arrangement of a golf club head for a putter including a pivotable alignment aide.
Figure 6B:
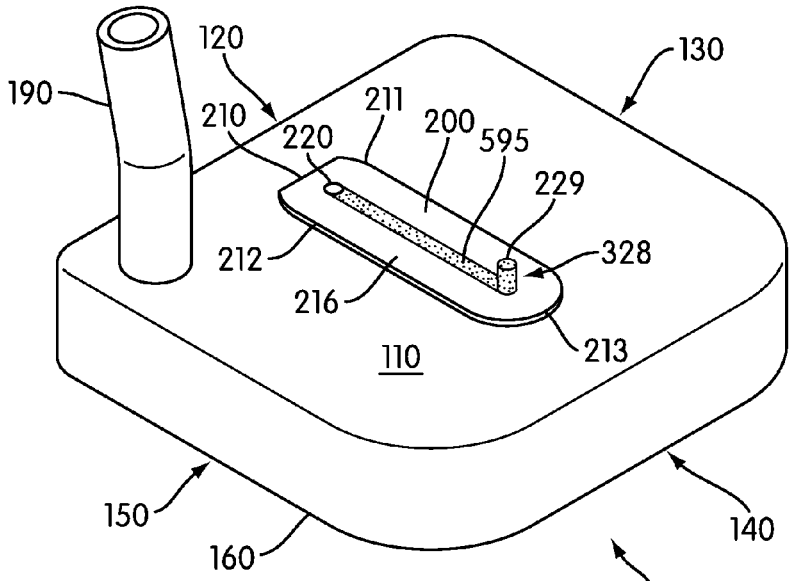

FIGS. 6A-6B illustratively depict a further configuration of a golf club head for a putter 100 including a pivotable alignment aide 200. Here, the pivotable alignment aide 200 is elongated and generally pill shaped. Pivotable alignment aide 200 houses a user engagement structure 228 housed at an end of the pivotable alignment aide 200 opposite the pivot 220. The user engagement structure 228 facilitates a user's manipulation of the pivotable alignment aide. Here, the pivotable alignment aide is a cylindrical shaped rod 229 protruding upward from and perpendicular to the top surface 216 of the pivotable alignment aide 200. A user may place his finger or hand in contact with rod 229 and may rotate the pivotable alignment aide as desired as the rod 229 is coupled to the pivotable alignment aide 200 such that movement of the rod 229 will cause associated movement of the pivotable alignment aide 200. As such, the pivotable alignment aide 200 may be easily adjusted, rotated or manipulated.

The user engagement structure 328 may be formed of various materials and configurations. For example, the user engagement structure may be formed of the same material as the pivotable alignment aide 200 and be attached or formed as part of the pivotable alignment aide 200 in a unibody or unimember construction through molding or other manufacturing processes. User engagement mechanism 328 may also be attached later as an add-on to the pivotable alignment aide 200 using any number of adhesives, glues or fasteners. The user engagement mechanism 328 may be formed of a distinct material than the pivotable alignment aide 200 as well. For example, if the pivotable alignment aide 200 is made of a metal, the user engagement mechanism 328 may be made of a polymer or other plastic and vice versa. Further, the user engagement mechanism 228 may possess many shapes and configurations. The pivotable alignment aide 200 may in itself include a user engagement mechanism 328 integrated into the shape of the pivotable alignment aide 200 such as shown in FIG. 3A-3B in which the raised nature of the pivotable alignment aide allows any of the sides 210, 211, 212 or any of the corners 213, 214, 215 serves as a user engagement mechanism by providing a surface for a user to push or pull or otherwise adjust the positioning of the pivotable alignment aide 200. In particular, corner 215 serves as an especially accessible user engagement mechanism 328 since it is an opposing end from the pivot 220 and may require minimal force to rotate the pivotable alignment aide 200 and will allow rotation to be accomplished through a larger arc with a smaller distance of rotation at the end near the pivot and in particular side 210. As such a mechanical advantage may be used to allow of preferred manipulation of the pivotable alignment aide 200. Therefore, fine adjustments may more easily be made in light of the location of the pivot 220 and corner 215. User engagement mechanisms 328 may possess a variety of shapes and locations and numerous configurations of user engagement mechanisms 328 are contemplated. In addition to those shown, one or more depressions or conversely one or more bumps in the top surface 216, protruding structures such as rods, T-shaped or I-shaped structures, loops, curves or other handle type structures and numerous other common arrangements and structures utilized for gripping, grasping, pushing, pulling or otherwise manipulating or rotating a structure are contemplated.

The arrangement of a golf club head for a putter 100 of FIGS. 6A-6B further includes a visible alignment feature 595 housed on a top surface 216 running between pivot 220 and user engagement mechanism 228. The visible alignment feature 595 is aligned here with the generally elongated shape of the pivotable alignment aide such that the visible alignment feature 595 further emphasizes the visual affect of the visible alignment feature 595 such that when a golfer views the top surface 110 of the golf club head for a putter 100 and rotates the pivotable alignment aide 200 into the desired orientation, the visible alignment feature 595 provides an enhanced visual impression that aides the golfer's eye line or sight line. Here, the visible alignment feature 595 is a colored stripe running between the pivot and the user engagement mechanism 328. The stripe 595 is shaded to illustrate that the visible alignment feature may include a distinctly colored, textured, or reflective surface that may provide a bold and eye-catching visual impression. With this bold or eye-catching impression the golfer may more easily view the visible alignment feature 595 from an elevated position such as in a typical putting stance or other distances in which a golfer may view the golf club head for a putter 100 during a round of golf or during practice shots at a golf range or putting green. Bright colors or colors that contrast the remainder of the top surface 216 of the pivotable alignment aide 200 and/or the top surface 110 are contemplated. Also, reflective stripes and other techniques for making features visibly prominent are also contemplated. The visible alignment feature 595 may also be raised or recessed in the pivotable alignment aide 200 to further provide depth and further visibility characteristics. Yet another example of a visible alignment feature 595 is a bisecting line 590 which divides the isosceles triangle shaped pivotable alignment aide 200, such as the one depicted in FIG. 5A, into two symmetrical halves. Here, the visible bisecting line 590 further enhances the golfer's alignment when the pivotable alignment aide is positioned in the eye line of the golf aligned with a desired direction of travel. Since the visible bisecting line 590 runs perpendicular to front side/front end 210 on through the center of the pivotable alignment aide 200 ending at rear end/corner 215, the visible aligning cues of the pivotable alignment aide 200 is further enhanced.

Figure 7A:
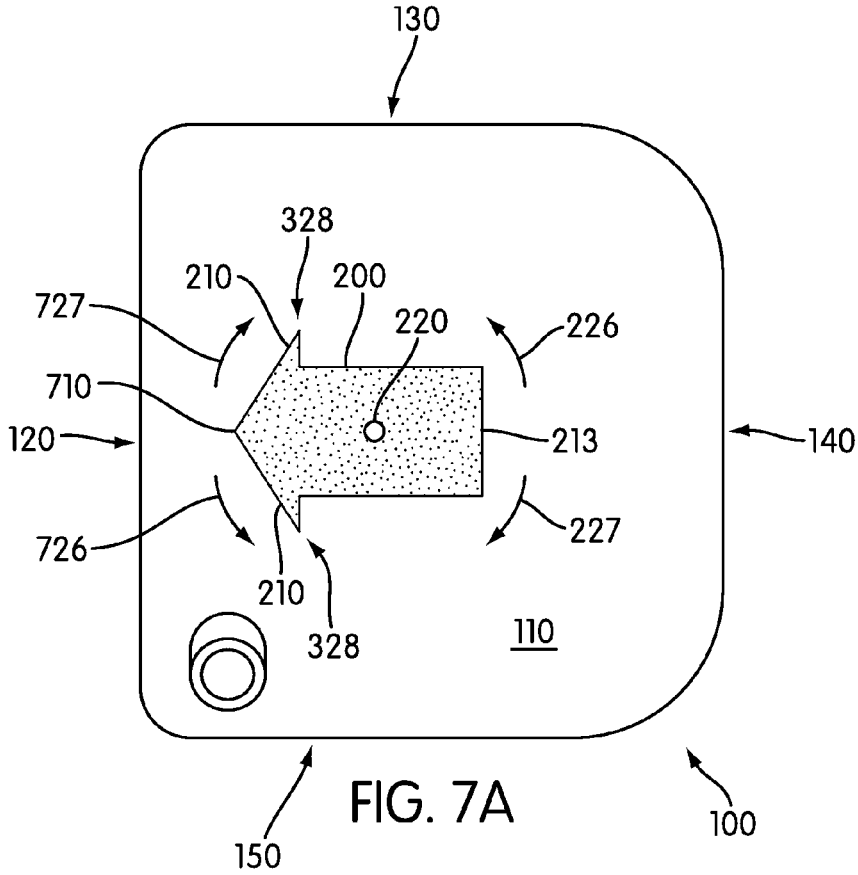
FIGS. 7A-7B are illustrative schematic top and rear perspective views of another arrangement of a golf club head for a putter including a pivotable alignment aide.
Figure 7B:
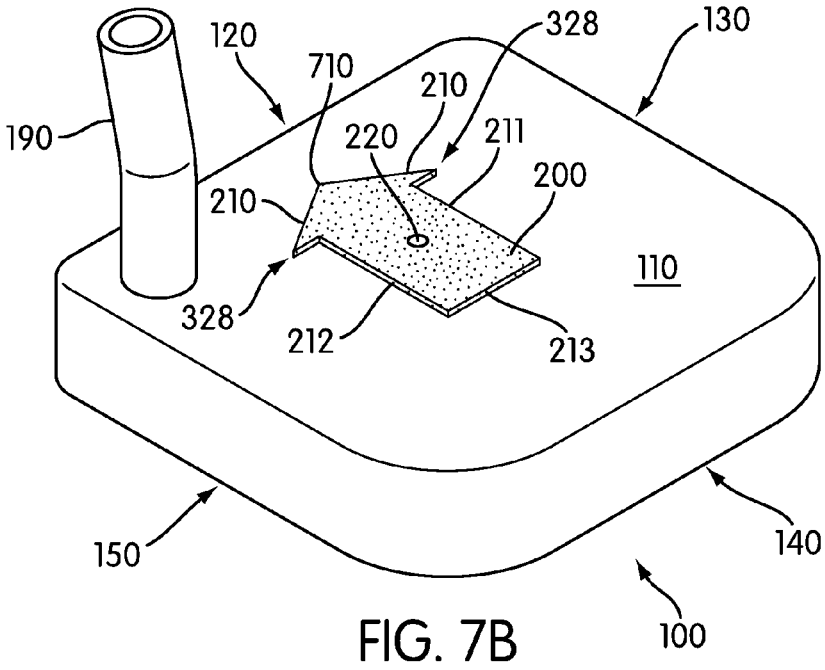

FIGS. 7A-7B are illustrative schematic top and rear perspective views of another arrangement of a golf club head for a putter 100 including a pivotable alignment aide 200. In the depicted configuration the pivotable alignment aide 200 is configured with the pivot 220 being centrally located within the surface area of the pivotable alignment aide 200, the pivotable alignment aide 200 also having a more squared shape than some of the other previously described illustrative configurations. In particular, the alignment aide of FIGS. 7A-7B is shaped to be a square region with a front side being a pointed end of an arrow 710. The pivot 220 is positioned generally in the center of the pivotable alignment aide 200 and accordingly front surfaces 210 are formed as the tip of an arrow. In this configuration the pivotable alignment aide 200 may be rotated consistent with the manners and mechanisms described to position the arrow shaped pivotable alignment aide 200 such that the tip of the arrow 710 points in the direction of the desired travel path of the golf ball 202. As is demonstrated in FIGS. 7A-7B, the positioning of the pivot 220 more centrally in the pivotable alignment aide 200 results in the rotation characteristics of the pivotable alignment aide 200 to be varied. Rather than having a rotating end 215 and swivel end 210 in which the rotating end 215 is opposite the pivot 220 and the swivel end 210 is close to the pivot 220 such that the rotating end 215 moves a comparatively greater distance than the swivel end 210 when the pivotable alignment aide 200 is rotated, here, both the front end 710 and the rear end 213 rotate through generally equivalent distances. If a pivotable alignment aide 200 is configured with a pivot 220 positioned at the exact center point between two opposing ends, those two opposing ends will rotate in equivalent but opposing directions as demonstrated by the angles and directions of rotation illustratively shown as arrows 226, 726, 227, 727. As shown, assuming that the pivot 220 is at the center point between corner or point 710 and rear side or rear end 213, these two opposing ends will rotate in equal magnitude but opposite directions about pivot 220. For example, if a golfer pushes on side 212 near the rear end 213 in the direction of the toe end 130 of the golf club head for a putter 130 causing the rear end 213 to rotate a rotation range 226 as shown, then the front end 710 will rotate that same magnitude but in an opposing direction as illustratively shown with rotation range arrow 726. Likewise, if the rear end 213 is rotated as demonstrated with rotation range 227, then the front end 710 will rotate with the same magnitude but with an opposing direction about the pivot as demonstratively shown with rotation range arrow 727. As described, this configuration of pivotable alignment aide 200 thereby possesses a distinct rotation characteristic as compared to configurations in FIGS. 3-5. The distinctions between these configurations thus illustratively demonstrate variability of the golf club head for a putter 100 with a pivotable alignment aide 200 depending on specific characteristics such as placement of the pivot and shape of the pivotable alignment aide 200, to name a few.

Figure 8A:
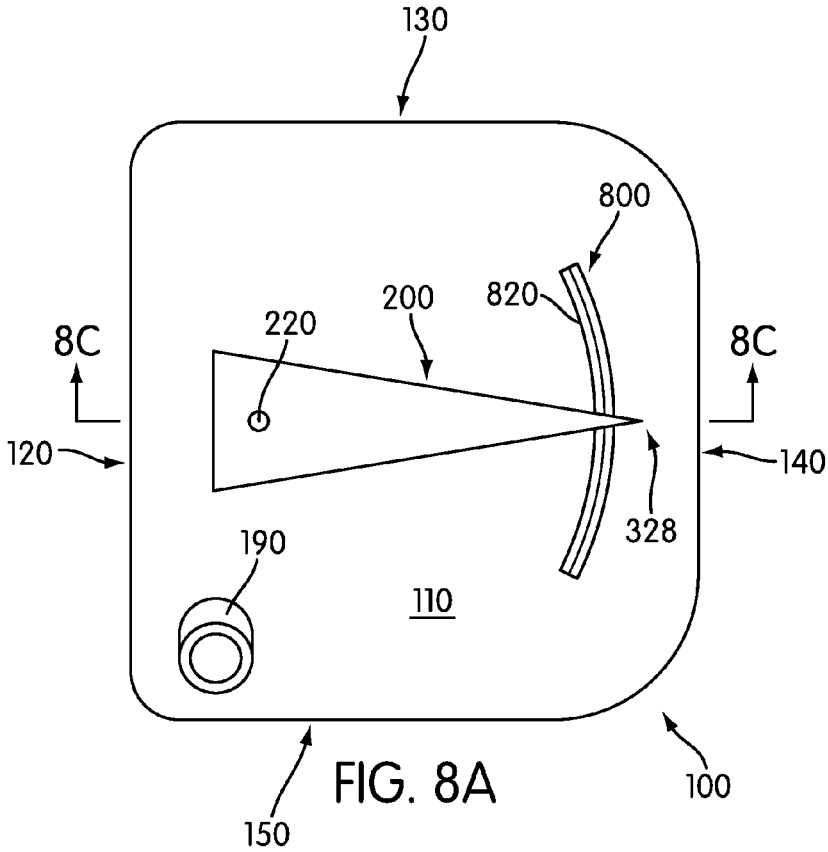
FIGS. 8A-8B are illustrative schematic top and rear perspective views of another arrangement of a golf club head for a putter including a pivotable alignment aide.
Figure 8B:
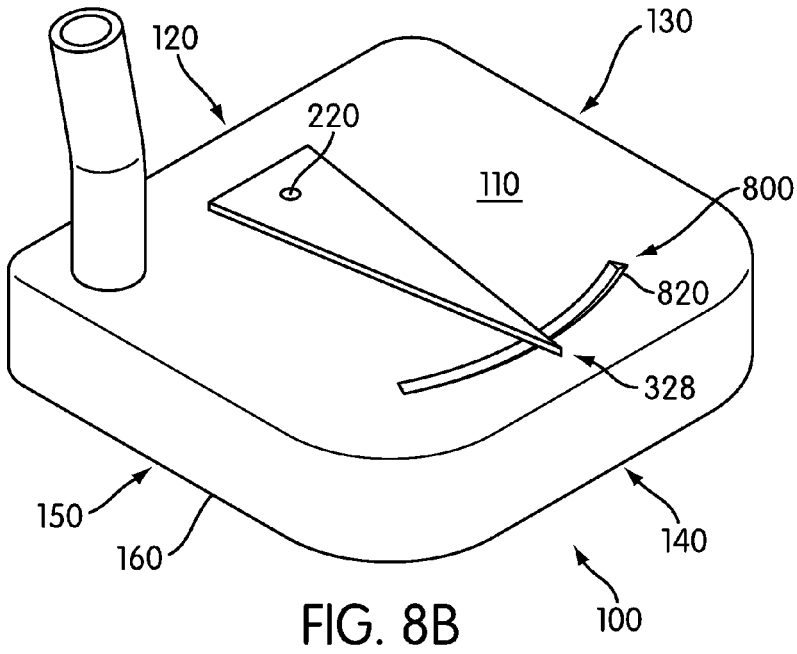
Figure 8C:
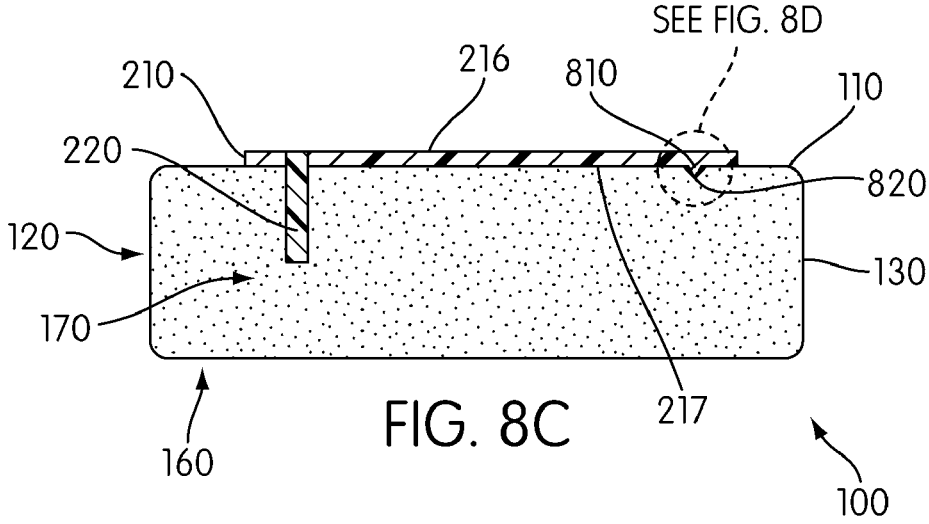
FIGS. 8C-8D are cut-away rear views of the arrangement of a golf club head for a putter of FIGS. 8A-8B.
Figure 8D:
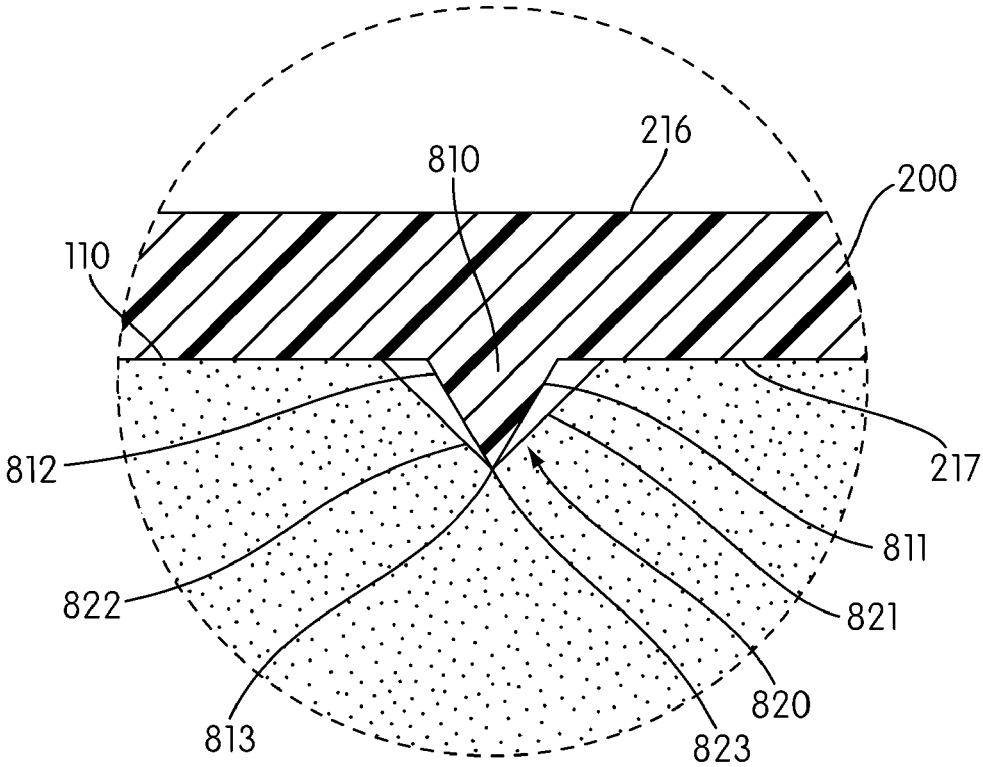

FIGS. 8A-8B are illustrative schematic top and rear perspective views of another arrangement of a golf club head for a putter 100 with FIGS. 8C-8D being cut away rear views of the arrangement of a golf club head for a putter of FIGS. 8A-8B. The golf club head for a putter 100 includes a pivotable alignment aide 200 similar to those previously described and further includes a pivot guidance mechanism 800. The pivot guidance mechanism 800 is configured to assist in movement of the pivotable alignment aide 200. Various configurations and components may be used in a pivot guidance mechanism 800 ranging from track and follower mechanisms, to ball bearings, to rotational mechanisms to sliders and various other guide movement features. Because a pivotable alignment aide 200 is generally configured so as to be rotationally fixed to the top surface 110 of a golf club head such as a golf club head for a putter 100, a pivot guidance mechanism 800 can be used in certain circumstances to facilitate desired movement and rotational characteristics while allowing the pivotable alignment aide 200 to still be securely fixed to the top surface 110. Since free motion may be undesirable in certain circumstances, the pivot guidance mechanism 800 may enable certain movement paths such as rotation in opposing directions about a pivot 220 even though the pivotable alignment aide is securely coupled to the golf club head 100. Pivot guidance mechanisms 800 may also facilitate manufacturing desirability in terms of ease of manufacture and cost as the pivot mechanism may enable a less complex pivot 220 or other mechanism of securing the golf pivotable alignment aide 200 to the golf club head 100. As shown, in FIG. 8A, the pivot guidance mechanism 800 may include a complimentary track 820 and follower 810. The track 820 may take any of a number of shapes. The cross-section of the track 820 may be a "V" shape or a "U" shape, a half circle, or various other shapes that have a complimentary shape such that the follower 810 may be formed with a complimentary shape for slidable or movable engagement between the follower 810 and the track 820.

Cross-sectional cutaway views of FIG. 8C-8D further show illustrative interaction between the pivotable alignment aide 200 and portions of the golf club head for a putter 100 including the track 820 and follower 810. Here, a "V" shaped follower 810 is configured to slidably rotate about pivot 220 as point 813 slidably engages and rests on the groove 823 of the track 820. As shown, the follower here is shaped to have a triangular shaped cross-section with sides 811, 812 meeting at the bottom engagement point 813 that is generally complimentary in shape and size to sides 821, 822 and groove 823 of the track 820. In other configurations the track 820 and follower 810 may be formed to have a "tighter fit" such the shape and size of the track and follower are further complimentary such that very little space exists between the sides 811, 812 and 821, 822. When the pivotable alignment aide 200 is rotated, the bottom surface 217 of the pivotable alignment aide 200 may skim the top surface 110 of the golf club head 100 or may rotate freely just above top surface 110. While the pivot 220 may be sufficiently resistive and of tight tolerances such that a pivot guidance mechanism 800 may not be needed to help keep the rotational alignment in the desired position, use of a pivot guidance mechanism 800 permits looser tolerances to be utilized with respect to the pivot 220, thus easier manufacturing and/or reduced risk that the pivot 220 will seize or get stuck due to interference or obstruction at the pivot 220. Various pivot configurations are discussed in further detail below.

While not specifically shown here, the track 820 and follower 810 may be configured such that the components are further housed within the interior region of the interior body 170 of the golf club head for a putter 100. In such a configuration the track 820 may be completely housed in the interior of the body of the golf club head for a putter 100 such that it is not visible from the exterior of the golf club head 100. Also, the follower 810 may also be configured so as to not be visible from the exterior of the golf club head for a putter 100. As such, the only visible indication of the track 820 and follower 810 may be a slit in the top surface 110 of the golf club head for a putter 100 allowing space for the follower 810 to move about the pivot 220 though the interior body of the golf club head for a putter 100. However, in certain configurations the entire pivot guidance mechanism 800 may be completely hidden or not visible from an exterior of the golf club head 100 if the pivotable alignment aide 200 is configured to be wide enough such that the entire slit in a top surface 110 is covered at all times by the pivotable alignment aide regardless of position or orientation.

Figure 9:
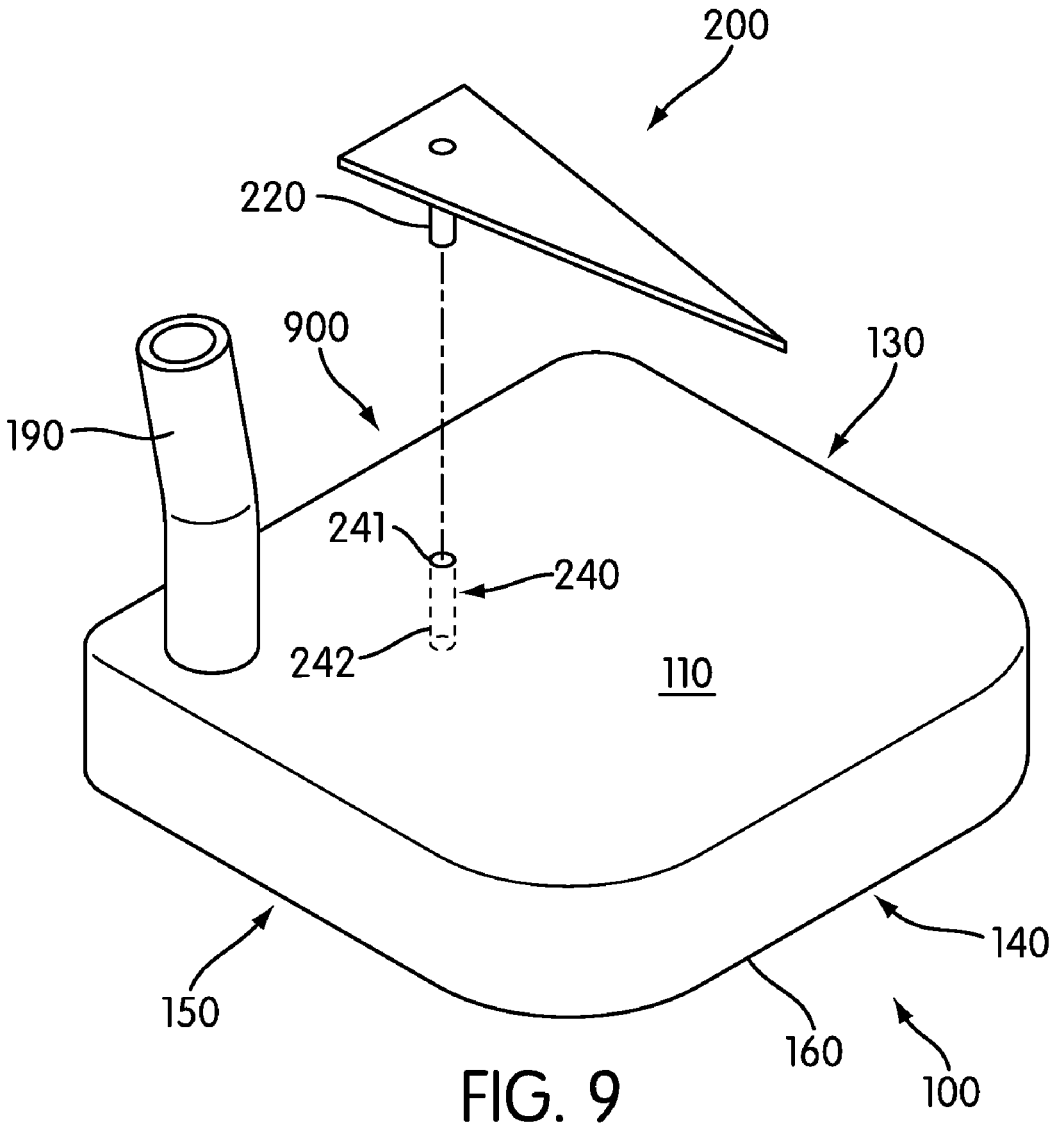
FIG. 9 is an illustrative exploded schematic view of a golf club head for a putter and a pivotable alignment aide.

FIG. 9 is an illustrative exploded schematic view of a golf club head for a putter 100 and a pivotable alignment aide 200. The exploded view of FIG. 9 demonstrates one configuration of the rotatable connection of the pivotable alignment aide to the golf club head 100. Pivot 220 may in one configuration be a cylindrical member extending downward from a bottom surface 217 of the pivotable alignment aide 200 into an interior region 170 (see FIG. 8C) of the golf club head 100. Pivot 220 may be formed as a male portion of a connection and is configured to complimentarily fit in pivot housing 240. Pivot housing 240 includes an open hole top surface 241 that sits flush with the remainder of the top surface 110 of the golf club head 100. Housing 240 further includes a cylindrical wall(s) 242 extending downward further into the golf interior 170 of the golf club head 100 and down to a bottom of the housing 240. In the depicted configuration the pivot 220 and associated housing 240 are cylindrical in shape. However, numerous other complimentary shapes may be utilized. For example, the pivot 220 may be shaped in a star, an "X-shaped", or a cross-shaped cross section, the housing 240 having an interior surface complimentary in shape and size to snugly fit the pivot 220.

The pivot 220 may typically be coupled to the golf club head for a putter 100 with a resistive connection 900 such that the pivot 220 and the associated pivotable alignment aide 200 are not permitted to rotate freely but rather require application of a force to cause rotation of the pivot 220. The resistive connection 900 may be accomplished through numerous arrangements. In one arrangement, the pivot 220 may be snugly fit or shrunk fit within the housing 240 such that rotation of the pivot 220 causes the outer surfaces of the pivot 220 to frictionally engage the interior surface(s) of the housing 240. When a the force applied to cause rotation of the pivot 220 and the coupled pivotable alignment aide 200 is removed or stopped, the pivot 220 (and the pivotable alignment aide 200) will cease rotation as the resistive force (here friction between the surfaces of the pivot 220 and the housing 240) will hold the pivotable alignment aide 200 in its current orientation. In other configurations, a softer solid material such as a rubber, plastic, clay-like material or other similar material may be placed between the pivot 220 and the housing 240 such that the soft solid material also supplies a resistive force when the pivot is rotated. This configuration may resemble an assembly with a washer or other structure. Also, the pivot and housing may be directly coupled together and a resistive connection may connect the housing 240 (including the pivot 220) to the remainder of the golf club head 100.

Figure 10A:
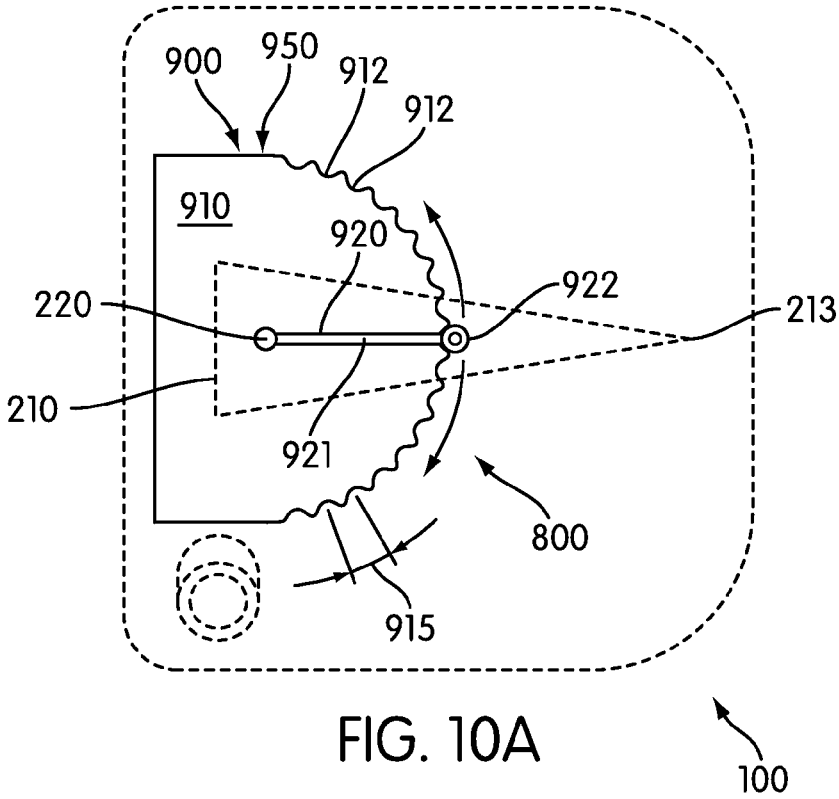
FIGS. 10A-10B are illustrative top plan and rear perspective schematic views of a connection of the pivotable alignment aide and the golf club head for a putter.
Figure 10B:
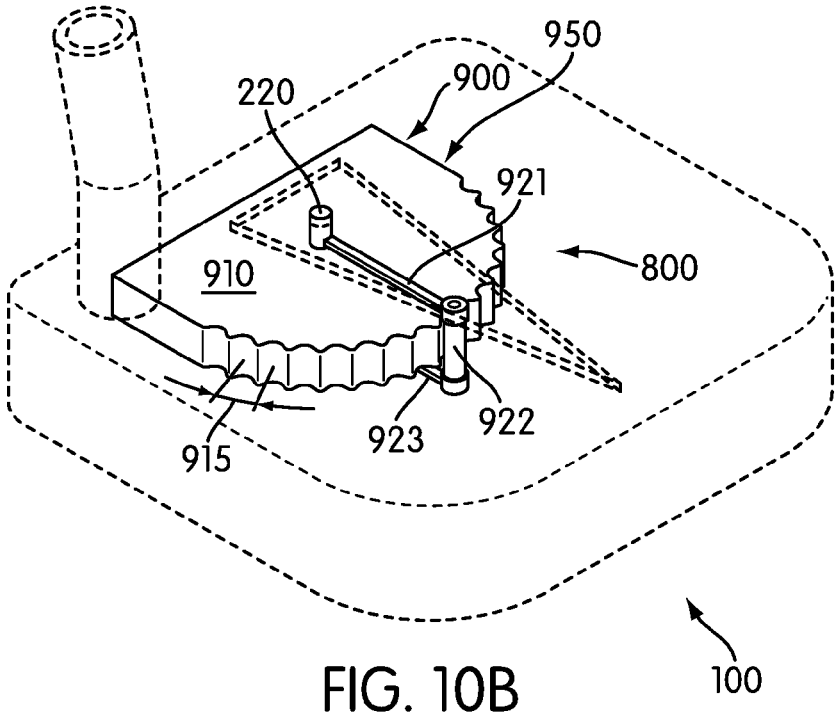

FIGS. 10A-10B are illustrative top and rear perspective schematic views of another configuration of a resistive connection 900 of the pivotable alignment aide 200 and the golf club head for a putter 100. The resistive connection 900 and pivot guidance mechanism 800 shown may be described as a ratchet mechanism 950. Ratchet mechanism 950, as depicted in FIGS. 10A-10B may be housed within the internal body 170 of the golf club head for a putter 100, on a top surface 110, or at various other locations on the golf club head for a putter 100 so as to facilitate desired orientation and functionality of the ratchet mechanism 950 without disrupting the putting traits and characteristics of the golf club head for a putter 100. Further, portions of the ratchet mechanisms 950 may be housed internally in the golf club head 100 while certain other portions, for example portions connected to the bottom surface 217 of the pivotable alignment aide 200, may be external to the golf club head for a putter 100. The ratchet mechanism 950 configuration shown here includes a grooved body 910 and rotational member 920. The rotational member 920 has a pivot 220 and a pair of arm members 921, 923 extending parallel to each other and perpendicular to the pivot 220. On an end opposing the pivot 220 is a pin 922 configured to have an outer surface complimentary in shape and size to the grooves 912 spaced about a circumference of the grooved body 910. A top of each of the respective pivot 220 and pin 922 is attached to the bottom surface 217 of the pivotable alignment aide 200 (shown in phantom broken lines for illustrative purposes).

To move the pivotable alignment aide 200, a user will apply a force to the pivotable alignment aide 200 so as to cause the pin 922 to slide or roll to the next groove 912 depending on the desired direction of rotation. With both the pivot 220 and the pin 922 attached to bottom surface 217 of the pivotable alignment aide 200 and the pin 922 securely housed in its position in the golf club head 100, the pivotable alignment aide 200 is thereby pivoted in incremental fashion from a first groove to a second groove (each labeled as 912) as demonstrated by incremental pivot spacing 915. Accordingly, a ratchet mechanism 950 may be utilized such that the pivotable alignment aide 200 is configured to have a finite number of positions or orientations and/or such that the pivotable alignment aide may be pivoted in a given angular or linear distance each time the pin 922 is caused to move from one groove to a next groove in succession. Depending on the desired characteristics as is known in the art, the ratchet mechanism 950 may be configured such that the pin 922 of the ratchet mechanism 950 must be moved completely in one direction in order to then go back in the other direction. On the other hand, the configuration may have a freer range of motion such that it can be moved in either opposing direction at any point but for the end or maximum position of its range of rotation.

The ratchet mechanism 950 configuration may be considered to vary from other resistive connections 900 described herein in that the ratchet mechanism resistive connection 950 is a incremental resistive connection 900 while other configuration previously described were continuous resistive connections in that there were nearly an unlimited number of stop positions between the ends of the range of motion since each stopping position could be unique rather than one of a set number of incrementally spaced stop positions. Also, the ratchet mechanism 950 is shown as having grooves 912 uniformly spaced about the perimeter or circumference of groove body 910. However, it is contemplated that the spacing of the grooves 912 may be varied moving about the grooved body 910 especially as the grooves 912 are positioned further outward so as to facilitate desired pivot and movement characteristics. Since the pin 922 is constrained in the number of positions that it can securely rest such that pivotable alignment aide 200 will not be easily moved by the location and frequency of the grooves 912, placement of the grooves 912 will be generally determinative of the particular orientations the pivotable alignment aide 200 may be moved to and through. Likewise, the shape of the ratchet mechanism 950 including shape of the grooved body 910 will also be determinative of the movement path and accordingly more complex rotation patterns may be accomplished utilizing a more complicated and/or intricate shaped grooved body 910 along with grooves 912 strategically placed to cause a particular motion path.

Numerous ratchet mechanisms 950 and other related mechanism are known.

Further, many other resistive connections 900 for moveably connecting two solid structures to securely allow movement such that the movement is restricted by a resistive force are known in the art. These known connections may be utilized for coupling the pivotable alignment aide 200 to the remainder of the golf club head 100 consistent with the principles described herein.

Illustrative aspects of the present invention is disclosed above and in the accompanying drawings with reference to a variety of embodiments. The purpose served by disclosure of the embodiments, however, is to provide an example of the various aspects embodied in the invention, not to limit the scope of the invention. One skilled in the art will recognize that numerous variations and modifications may be made to the embodiments without departing from the scope of the present invention, as defined by the appended claims.

The inventions claimed is:

1. A golf club head comprising:

a body;

a front surface including a hitting surface;

a pivotable alignment aide non-removably located on a top surface of the body including a swivel end and a rotating end on opposing sides of a pivot, the swivel end being the single shortest side of the pivotable alignment aide, the side of the pivotable alignment aide closest to the hitting surface in a first position, and parallel to the hitting surface in the first position, wherein the pivotable alignment aide is pivotable relative to the top surface and about an axis of rotation transverse to the top surface and configured to permit the rotating end and the swivel end to each rotate about the pivot in opposing directions relative to the first position; and an alignment aide pivot guidance mechanism.

2. The golf club head of claim 1, wherein a pivot enabling connection between the pivotable alignment aide and the top surface of the body is configured to provide a force resistive to rotation in both of the opposing directions of rotation such that the pivot enabling connection is a resistive connection.

3. The golf club head of claim 2, wherein the force resistive to rotation is friction between the pivotable alignment aide and the body at the resistive connection.

4. The golf club head of claim 1, further comprising a structure for coupling a shaft to the body.

5. The golf club head of claim 4, wherein the golf club head is configured for a putter.

6. The golf club head of claim 1, wherein the axis of rotation is centrally located within the pivotable alignment aide such that the pivotable alignment aide is configured with two opposing rotating ends that rotate through equivalent arcs in opposing directions about the pivot during rotation of the pivotable alignment aide.

7. The golf club head of claim 1, wherein the pivotable alignment aide is configured to be visually distinct relative to the top surface of the body.

8. The golf club head of claim 1, wherein the golf club head is a putter head.

9. A golf club head comprising:

a body;

a front surface including a hitting surface;

a pivotable alignment aide non-removably located on a top surface of the body including a swivel end and a rotating end on opposing sides of a pivot, the swivel end being the single shortest side of the pivotable alignment aide, the side of the pivotable alignment aide closest to the hitting surface in a first position, and parallel to the hitting surface in the first positon, wherein the pivotable alignment aide is pivotable relative to the top surface and about an axis of rotation transverse to the top surface and configured to permit the rotating end and the swivel end to each roate about the pivot in opposing directions relative to the first position;

a first range of pivot of the rotating end and a second range of pivot of the rotating end, the first and second range of pivot of the rotating end being equivalent and in opposing directions from the first position at which the swivel end is parallel to the hitting surface; and a pair of rotation stops, each of the rotation stops being housed on the top surface of the body and forming a pivot range boundary to one of the respective first and second ranges of pivot of the rotating end.

10. The golf club head of claim 9, wherein the first and second ranges of pivot are each ten degrees.

11. A golf club head, comprising:

a body;

a front surface including a hitting surface;

a pivotable alignment aide non-removably located on a top surface of the body including a swivel end and a rotating end on oppoing sides of a pivot, the swivel end being the single shortest side of the pivotable alignment aide, the side of the pivotable alignment aide closest to the hitting surface in a first position, and parallel to the hitting surface in the first position, wherein the pivotable alignment aide is pivotable relative to the top surface of about an axis of rotation transverse to the top surface and configured to permit the rotating end and the swivel end to each rotate about the pivot in opposing directions relative to the first position; and wherein the perimeter of the pivotable alignment aide is an isosceles triangle.

12. A golf club head, comprising:

a body;

a front surface including a hitting surface;

a pivotable alignment aide non-removably located on a top surface of the body including a swivel end and a rotating end on opposing sides of a pivot, the swivel end being the single shortest side of the pivotable alignment aide, the side of the pivotable alignment aide closest to the hitting surface in a first position, and parallel to the hitting surface in the first position, wherein the picotable alignment aide is pivotable relative to the top surface and about an axis of rotation transverse to the top surface and configured to permit the rotating end and the swivel end to each rotate about the pivot in opposing directions relative to the first position; and wherein the pivotable alignment aide is triangularly shaped and is symmetrical across a line perpendicular to the hitting surface when the pivotable alignment aide is in the first position.

13. The golf club head of claim 12, wherein the line perpendicular to the hitting surface across which the pivotable alignment aide is symmetrical across is positioned on a top surface of the pivotable alignment aide and visible.

14. The golf club head of claim 12, further comprising a user engagement structure protruding from a top surface of the pivotable alignment aide and configured to facilitate user manipulation of the pivotable alignment aide.

15. A golf club head, comprising:

a body;

a front surface including a hitting surface;

a pivotable alignment aide non-removably located on a top surface of the body including a swivel end and a rotating end on opposing sides of a pivot, the swivel end being the single shortest side of the pivotable alignment aide, the side of the pivotable alignment aide closest to the hitting surface in a first position, and parallel to the hitting surface in the first position, wherein the pivotable alignment aide is pivotable relative to the top surface and about an axis of rotation transverse to the top surface and configured to permit the rotating end and the swivel end to each rotate about the pivot in opposing directions relative to the first position, and an incremental pivot configured such that the pivoting end rotates in predefined increments about the pivot.

16. The golf club head of claim 15, wherein the incremental pivot includes a ratchet mechanism.

17. A golf club head, comprising:

a body;

a front surface including a hitting surface;

a pivotable alignment aide non-removably located on a top surface of the body including a swivel end and a rotating end on opposing sides of a pivot,the swivel end being the single shortest side of the pivotable alignment aide, the side of the pivotable alignment aide closest to the hitting surface in a first position, and a parallel to the hitting surface in the first position, wherein the pivotable alignment aide is pivotable relative to the top surface and about an axis of rotation transverse to the top surface and configured to permit the rotating end and the swivel end to each rotate about the pivot in opposing directions relative to the first position; and wherein the pivotable alignment aide is housed in a recess of the top surface of the body and configured such that a top surface of the pivotable alignment aide is flush with the top surface of the body.

* * * * *

UNITED STATES PATENT AND TRADEMARK OFFICE

CERTIFICATE OF CORRECTION

PATENT NO. : 8,075,416 B2
APPLICATION NO. : 12/862047
DATED : December 13, 2011
INVENTOR(S) : John T. Stites et al.

It is certified that error appears in the above-identified patent and that said Letters Patent is hereby corrected as shown below:

In the Claims:

Column 16, Claim 9, Line 7:
Please delete “roate” and insert -- rotate --

Column 16, Claim 12, Line 47:
Please delete “picotable” and insert -- pivotable --

Signed and Sealed this
Twelfth Day of June, 2012

David J. Kappos

David J. Kappos
*Director of the United States Patent and Trademark Office*